US007645027B2

(12) United States Patent
Watanabe

(10) Patent No.: US 7,645,027 B2
(45) Date of Patent: Jan. 12, 2010

(54) PRINT HEAD WITH THERMOMECHANICAL ACTUATOR

(75) Inventor: Kenjiro Watanabe, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 351 days.

(21) Appl. No.: 11/765,049

(22) Filed: Jun. 19, 2007

(65) Prior Publication Data

US 2007/0296766 A1 Dec. 27, 2007

(30) Foreign Application Priority Data

Jun. 21, 2006 (JP) ..... 2006-171691

(51) Int. Cl.
*B41J 2/04* (2006.01)

(52) U.S. Cl. ..... 347/54; 347/56

(58) Field of Classification Search ..... 347/54, 347/56, 20, 65, 70–72, 48, 68; 310/306, 310/307, 328–330; 337/139–141
See application file for complete search history.

(56) References Cited

U.S. PATENT DOCUMENTS 6,598,960 B1 7/2003 Cabal et al.
6,631,979 B2 10/2003 Lebens et al.
6,817,702 B2 * 11/2004 Delametter et al. ..... 347/56
6,824,249 B2 11/2004 Delametter et al.

FOREIGN PATENT DOCUMENTS

JP 2003-260696 9/2003
JP 2004-1517 1/2004
JP 2004-82733 3/2004

* cited by examiner

*Primary Examiner*—Juanita D Stephens
(74) *Attorney, Agent, or Firm*—Fitzpatrick, Cella, Harper & Scinto

(57) ABSTRACT

A print head using a thermomechanical actuator is capable of improving ejection efficiency and improving print quality by stabilizing an ejecting direction. In a print head for ejecting droplets with the thermomechanical actuator having a first layer and a second layer, the first layer includes a heat generation layer and the second layer includes a plurality of dielectric layers. The thermomechanical actuator includes a fixed end and a free end. The plurality of dielectric layers are laminated on a droplet ejecting side in relation to the heat generation layer and between the fixed end and the free end at the same film thickness. A linear expansion coefficient of the dielectric layer of the fixed end side is smaller than that of the heat generation layer. A linear expansion coefficient of the dielectric layer of the free end side is larger than that of the heat generation layer.

6 Claims, 10 Drawing Sheets

PRINT HEAD WITH THERMOMECHANICAL ACTUATOR

BACKGROUND OF THE INVENTION

1. Field of the Invention

The present invention relates to a print head, more particularly, it relates to a print head for ejecting ink with a thermomechanical actuator to perform printing.

2. Description of the Related Art

As an ink ejecting method of a print head used for ink jet printing apparatuses, the following methods are known and utilized: a method for generating bubbles by applying thermal energy to ink; a method for ejecting the ink with an electrical-mechanical actuator constituted by a piezoelectric device; and the like. Additionally, a method using a thermomechanical actuator has been developed in terms of simplicity in processing and high degree of freedom of an ink composition.

Japanese Patent Laid-Open No. 2003-260696 discloses a print head using a thermomechanical actuator constituted of two layers, a heat generation layer and a dielectric layer which constitute a cantilever. The thermomechanical actuator including the heat generation layer and dielectric layer constituting the cantilever will be briefly described with reference to FIGS. 8A to 8C.

FIG. 8A is a top plan view of an ejecting portion of the print head (the top view indicates that the ejecting portion is viewed from the side in which an ink droplet is ejected). FIG. 8B is a cross sectional view taken along line VIIIB-VIIIB of the ejecting portion of the print head shown in FIG. 8A. FIG. 8C is a view for illustrating a state where the ink droplet is ejected from the ejecting portion of the print head shown in FIGS. 8A and 8B.

As shown in FIGS. 8A and 8B, a liquid chamber 2 is formed on a silicon substrate 1, and the ink droplets are ejected from a nozzle 3. A cantilever 4 as the thermomechanical actuator is formed in the liquid chamber 2. The cantilever 4 includes: a heat generation layer 20 which is divided into two heat generating portions by a slit; a conductor layer forming wiring portions 5 (5*a*, 5*b*) for supplying power to the two heat generating portions, and a turning electrode 11 for connecting the two heat generating portions to each other; and a dielectric layer 21. The cantilever 4 is formed in a manner that the heat generation layer 20 is first formed, the conductor layer then is laminated on the heat generation layer 20; and lastly the dielectric layer 21 is laminated on the heat generation layer 20 and the conductor layer. A linear expansion coefficient of the dielectric layer 21 is set so as to be smaller than that of the generation heat layer 20. Moreover, the whole cantilever 4 is covered with a thin electrically insulating film (not shown) because of contact with ink. When the two heat generation portions of the cantilever 4 is energized to generate heat, the cantilever 4 is bent upward (toward nozzle 3) due to a difference between the linear expansion coefficients of the heat generation layer 20 and the dielectric layer 21 as shown in FIG. 8C. Thus, ink 7, with which the liquid chamber 2 is filled, is formed into a droplet 8 to be ejected from the nozzle 3.

A cantilever 4 is disclosed in Japanese Patent Laid-Open No. 2004-1517 in which the dielectric layer 21 is sandwiched between the two heat generation layers 20 and 20. First, the upper side heat generation layer 20 is energized so that the cantilever 4 is bent in a direction opposite from the nozzle 3. Next, the lower side heat generation layer 20 is energized so that the cantilever 4 is bent toward the nozzle 3 as shown in FIG. 8C. Thus, the droplets can be ejected by a large driving force.

Additionally, a trapezoid cantilever 4 is disclosed in Japanese Patent Laid-Open No. 2004-82733 in which the width of a fixed end 9 of the cantilever 4 is larger than that of a free end 10 thereof. The large driving force is also obtained by this constitution, and the droplets 8 can be properly ejected.

The ejecting portions of the print heads are arranged zigzag so as to be arranged at high density, as shown FIG. 9. The arrangement allows the nozzles to be arranged at short pitches even if the width of the liquid chamber 2 is increased for ink supply.

Problems of the thermomechanical actuator including the heat generation layers and dielectric layer constituting the cantilever will be described with reference to FIGS. 10A and 10B.

As shown in FIG. 10A, when the cantilever is bent to the maximum, that is, when the free end 10 of the cantilever 4 is brought closest to an inner wall (a roof portion) of the liquid chamber 2, the cantilever 4 is brought into an inclined state from the free end 10 to the fixed end 9. In this state, as indicated by an arrow F in FIG. 10A, a part of the pressure for ejecting the droplets escapes to the fixed end 9, and thus ejection energy cannot be entirely used, and energy efficiency sometimes becomes insufficient.

Additionally, since the cantilever 4 is inclined, the free end 10 of the cantilever 4 does not become parallel with a face 3*a* (a nozzle face 3*a*) on which an ejection opening of a nozzle 3 is formed. Accordingly, since an ejection pressure is not applied perpendicularly to the nozzle face 3*a*, an ejecting direction of the droplet 8 is inclined at the angle θ in relation to a nozzle face vertical line v as shown in FIG. 10A. Thus, a landing point of the droplet 8 ejected from the nozzle 3 may deviate from a target point. When the ejecting portions of the print head are arranged zigzag as shown in FIG. 9, the droplet 8 ejected from the adjacent nozzle 3 of the print head is inclined at the angle −θ in relation to a nozzle face vertical line v as shown in FIG. 10B. That is, if it is assumed that an odd number is assigned to the nozzle shown in FIG. 10A, and that an even number is assigned to the nozzle shown in FIG. 10B, the landing point of the droplet ejected from the nozzle 3 of the odd number may largely deviate from that of the even number.

The present invention was made to solve the above problems. It is an object of the present invention to provide a print head using the thermomechanical actuator, wherein the deviation of the landing point of the droplet ejected from the ejecting portion of the print head is removed even if the ejecting portions of the print head or the nozzles are arranged at a high density. Further, it is an object of the present invention to provide a print head using a thermomechanical actuator which has a high ejection efficiency.

SUMMARY OF THE INVENTION

In order to achieve the above objects, the present invention provides a print head for ejecting droplets by a thermomechanical actuator having at least one first layer and one second layer, wherein the thermomechanical actuator includes a fixed end and a free end, the first layer of the thermomechanical actuator includes a heat generation layer, and the second layer thereof includes a plurality of dielectric layers having linear expansion coefficients different from each other.

Additionally, the present invention provides a print head for ejecting droplets by a thermomechanical actuator having at least one first layer and one second layer, wherein the first layer of the thermomechanical actuator includes a heat generation layer, the second layer thereof includes a plurality of dielectric layers having linear expansion coefficients different from each other, the thermomechanical actuator includes a fixed end and a free end, the plurality of dielectric layers are laminated on a droplet ejecting side in relation to the heat generation layer and between the fixed end and the free end at the same film thickness, a linear expansion coefficient of the dielectric layer of the fixed end side is smaller than that of the heat generation layer, and a linear expansion coefficient of the dielectric layer of the free end side is larger than that of the heat generation layer.

Further, the present invention provides a print head for ejecting droplets with a thermomechanical actuator having at least one first layer, and two second layers, wherein the first layer of the thermomechanical actuator includes a first heat generation layer, the two second layers thereof include first and second dielectric layers, the thermomechanical actuator includes a fixed end and a free end, the first dielectric layer is laminated at the fixed end side of the thermomechanical actuator and on a droplet ejecting side in relation to the first heat generation layer, and the second dielectric layer is laminated at the free end side of the thermomechanical actuator and on the side opposite from the first dielectric layer of the fixed end side in relation to the first heat generation layer.

Furthermore, the present invention provides a print head for ejecting droplets by a thermomechanical actuator having at least one first layer and two second layers, wherein the first layer of the thermomechanical actuator includes a first heat generation layer, the two second layers thereof include first and second dielectric layers, the thermomechanical actuator includes a fixed end and a free end, the first dielectric layer is laminated on a droplet ejecting side in relation to the first heat generation layer, and the second dielectric layer is laminated at the fixed end side of the thermomechanical actuator and further on the droplet ejecting side in relation to the first dielectric layer.

According to the above constitutions, since an inner wall (a roof portion) of a liquid chamber becomes parallel with an ejection pressure applying portion on the free end of the cantilever when the cantilever as the thermomechanical actuator is bent to the maximum, the ejection pressure can be prevented from escaping in a lateral direction, and ejection efficiency can be increased. Additionally, since an applying direction of the ejection pressure can be made to conform to an ejecting direction of the droplet, and since both ejecting directions of a main droplet and a satellite droplet can be kept orthogonal to a nozzle face to stabilize, print quality can be improved. Further, in the case where the liquid chambers are arranged zigzag, a difference between the ejecting directions of the droplets ejected from the liquid chamber of an odd number and the liquid chamber of an even number can be reduced, thereby deviation of a landing point is reduced, and thus the print quality can be improved. Additionally, ink residual quantity not to be ejected in a gap between an inner wall of the liquid chamber and the ejection pressure applying portion of the cantilever can be reduced when the cantilever as the thermomechanical actuator is bent to the maximum, the ink can be ejected together with bubbles even if the bubbles are generated, and thus the bubbles can be prevented from accumulating.

Further features of the present invention will become apparent from the following description of exemplary embodiments (with reference to the attached drawings).

BRIEF DESCRIPTION OF THE DRAWINGS

FIG. 1A is a cross sectional view of an ejecting portion of a print head according to the first embodiment. FIG. 1B is a cross sectional view of the ejecting portion of the print head for description of droplet ejecting in the case where a second dielectric layer is laminated at a free end side. FIG. 1C is a cross sectional view of the ejecting portion of the print head for description of droplet ejecting in the case where a metal layer having a large linear expansion coefficient is laminated at the free end side;

FIG. 2A shows the state where the droplet is ejected from the ejecting portion of an odd number in the ejecting portions of the print heads arranged zigzag. FIG. 2B shows the state where the droplet is ejected from the ejecting portion of an even number;

FIG. 3A is a cross sectional view of an ejecting portion of a print head according to the second embodiment. FIG. 3B shows a state where a free end of a thermomechanical actuator is bent to the side opposite from a nozzle. FIG. 3C shows a state where the free end of the thermomechanical actuator is bent toward the nozzle and the droplet is ejected;

FIG. 4A is a cross sectional view of an ejecting portion of a print head according to the third embodiment. FIG. 4B shows a state where a free end of a thermomechanical actuator is bent toward a nozzle and the droplet is ejected;

FIG. 5A is a cross sectional view of an ejecting portion of a print head according to the fourth embodiment. FIG. 5B shows a state where a free end of a thermomechanical actuator is bent to the side opposite from a nozzle. FIG. 5C shows a state where the free end of the thermomechanical actuator is bent toward the nozzle and the droplet is ejected;

FIG. 8A is a top plan view, FIG. 8B is a cross sectional view taken along line VIIIB-VIIIB of the ejecting portion of the print head shown in FIG. 8A, and FIG. 8C shows a state where a free end of a thermomechanical actuator is bent toward a nozzle and the droplet is ejected;

FIG. 10A shows the state where the droplet is ejected from the ejecting portion of an odd number in the ejecting portions of the print head arranged zigzag. FIG. 10B shows the state where the droplet is ejected from the ejecting portion of an even number.

DESCRIPTION OF THE EMBODIMENTS

First Embodiment

Figure 1A:
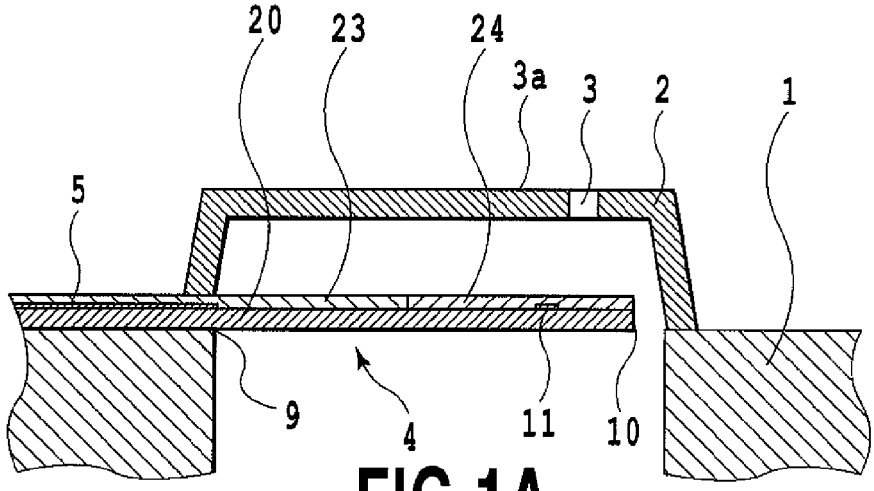
FIGS. 1A to 1C are views for description of a first embodiment according to the present invention.
Figure 1B:
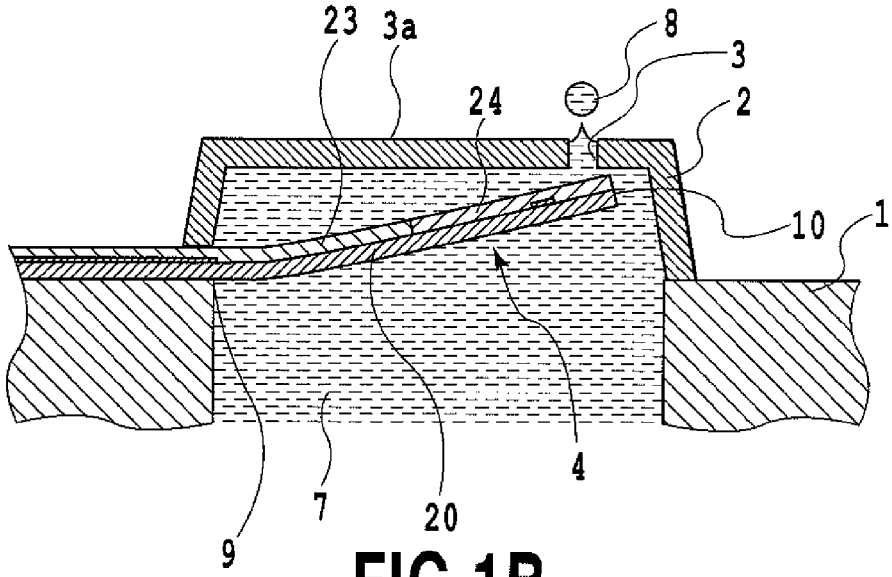
Figure 1C:
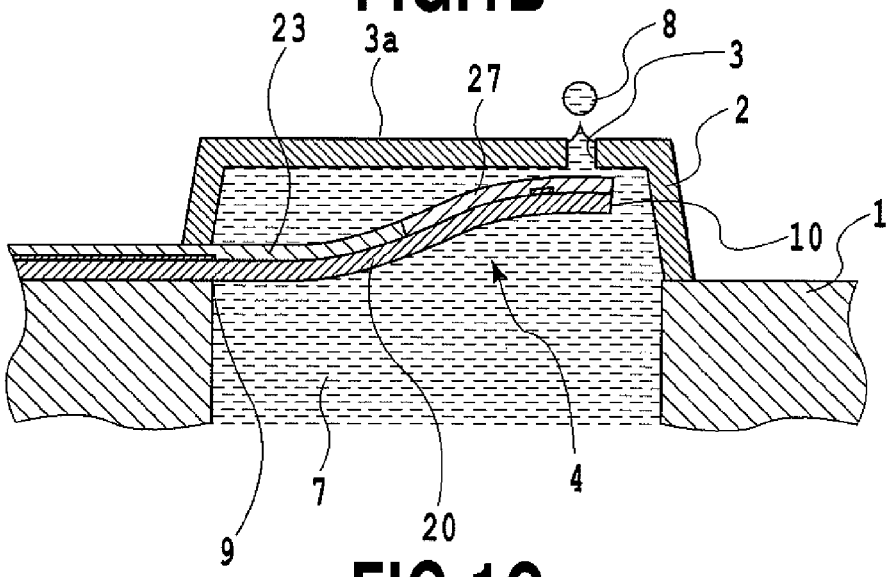
Figure 8A:
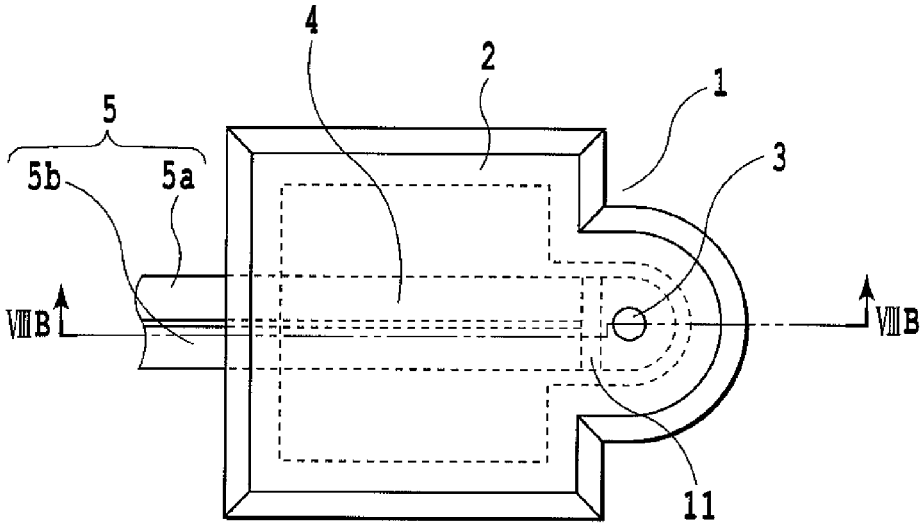
FIGS. 8A to 8C are each views of an ejecting portion of a conventional print head.
Figure 8B:
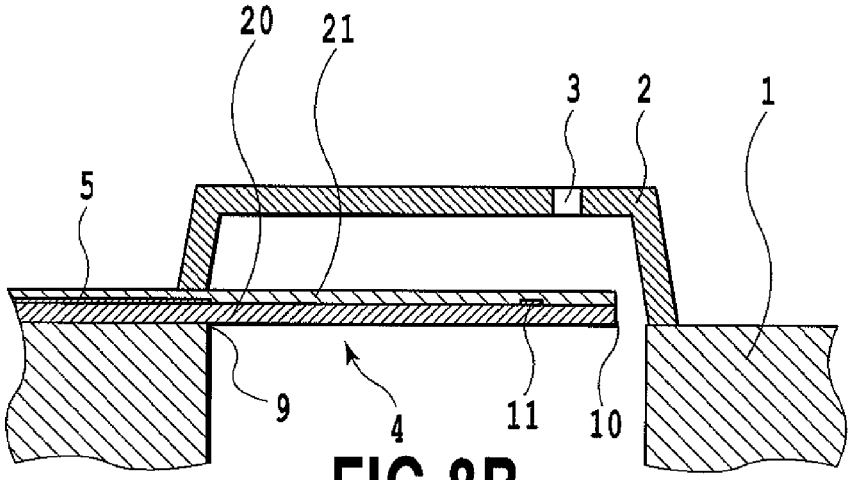
Figure 8C:
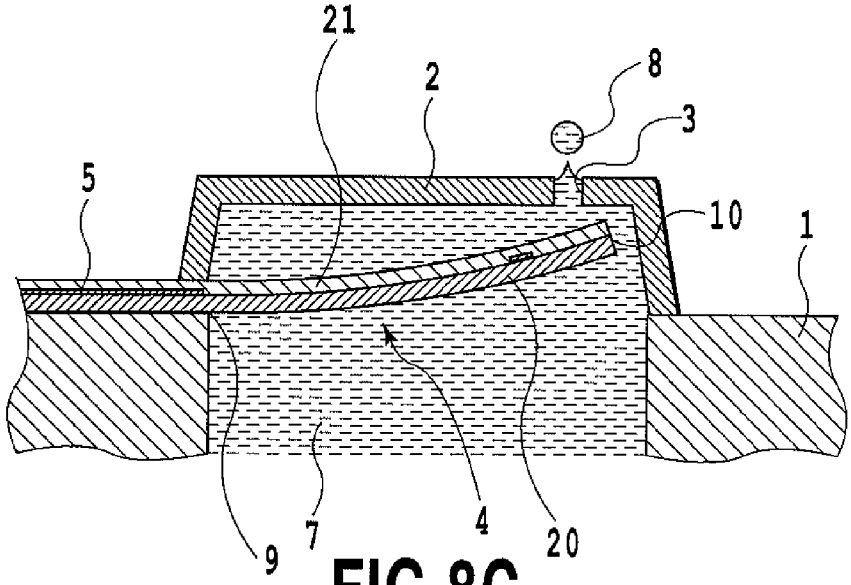
Figure 9:
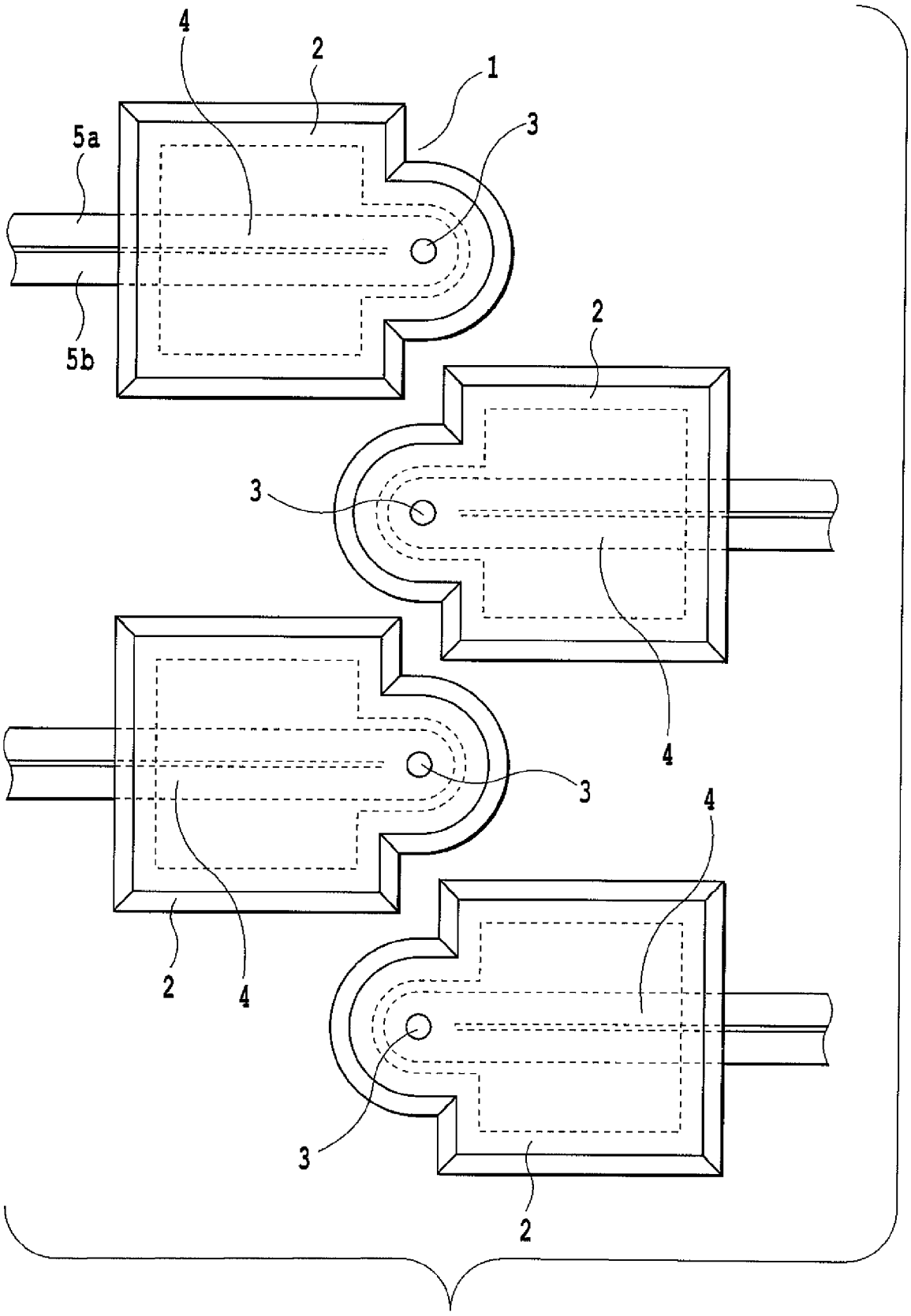
FIG. 9 is a top plan view of the ejecting portions of the conventional print head or the ejecting portions of the print head according to the present invention which are arranged zigzag.
Figure 10A:
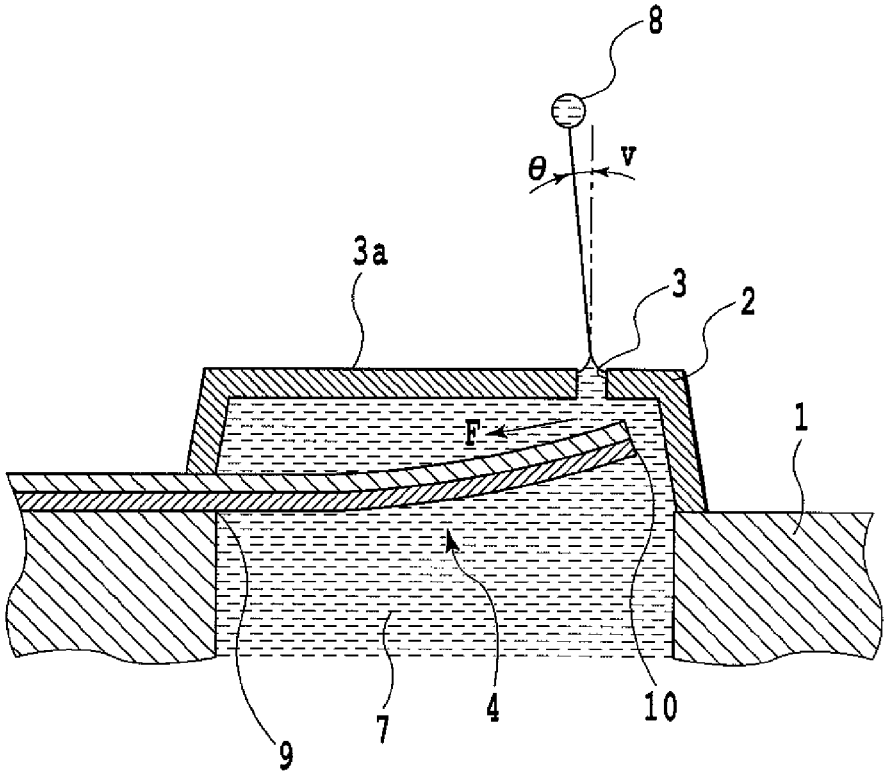
FIGS. 10A and 10B are views for describing a state where droplets are ejected from the ejecting portions of the conventional print head arranged zigzag.
Figure 10B:
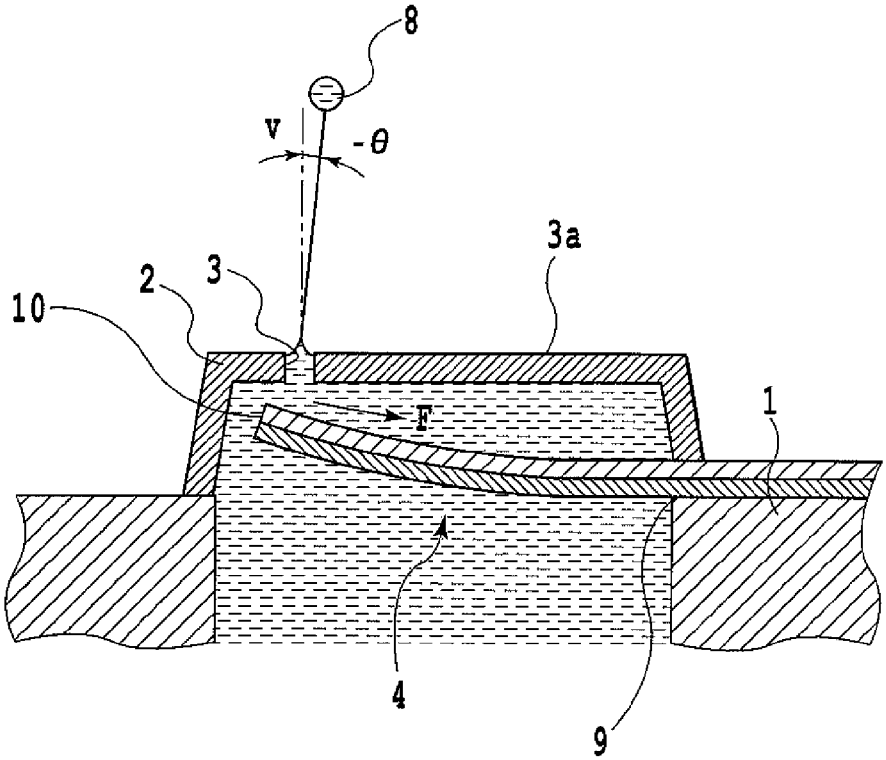

FIGS. 1A to 1C are each cross sectional views of an ejecting portion of a print head according to a first embodiment of the present invention. The ejecting portion of the print head of the embodiment has the same constitution as that of an ejecting portion of a conventional print head shown in FIGS. 8A and 8B except for a constitution of a cantilever 4. The constitution of the cantilever 4 will be briefly described below with reference to FIG. 1A (see FIGS. 8A and 8B).

The ejecting portion of the print head includes a silicon substrate 1 and a liquid chamber 2 formed on the silicon substrate 1. An ink droplet 8 is ejected from a nozzle 3. The cantilever 4 as a thermomechanical actuator supported by the silicon substrate 1 is extended in the liquid chamber 2. The cantilever 4 includes: a heat generation layer 20, which is divided into two heat generating portions by a slit, as a first layer; a conductor layer forming wiring portions 5 for supplying power to the two heat generating portions and a turning electrode 11 for connecting the two heat generating portions to each other; and dielectric layers 23 and 24 as a second layer.

The cantilever 4 as the thermomechanical actuator in the present invention includes the first layer constituted by the heat generation layer 20, and the second layer constituted by the first dielectric layer 23 and second dielectric layer 24 as shown in FIG. 1A. The heat generation layer as the first layer is constituted by a resistor, and the dielectric layer as the second layer is constituted by an electrical insulator. In the cantilever 4 of the embodiment, the first dielectric layer 23 is laminated on an upper surface (on the side of ejecting droplets) of the heat generation layer 20 and partially laminated at a fixed end 9 side. Additionally, the second layer 24 is also laminated on the upper surface (on the side of ejecting droplets) of the heat generation layer 20 and partially laminated at a free end 10 side. The first dielectric layer 23 has the same film thickness as that of the second dielectric layer 24.

A material of the first dielectric layer 23, which constitutes the second layer, of the fixed end 9 side is selected so as to have a linear expansion coefficient sufficiently smaller than that of the heat generation layer 20 constituting the first layer, and thus the fixed end 9 side of the cantilever 4 as the thermomechanical actuator is bent at a sufficiently large curvature. In order that a curvature of the free end 10 side of the cantilever 4 is lowered, a material of the second dielectric layer 24, which constitutes the second layer, of the free end 10 side is selected so as to have a linear expansion coefficient not much smaller than that of the heat generation layer 20 of the first layer. That is, in the embodiment, the linear expansion coefficient of the material selected for the first dielectric layer 23 is different from that of the material selected for the second dielectric layer 24. Thus, as shown in FIG. 1B, the curvature of the free end 10 side of the cantilever 4 becomes sufficiently small, and the free end 10 side of the cantilever 4 becomes an approximately linear shape. Accordingly, the free end 10 side of the cantilever 4 becomes approximately parallel with an inner wall (a roof portion) of the liquid chamber compared with that of a conventional cantilever even if being bent to the maximum.

Further, it is preferable that the linear expansion coefficient of the second dielectric layer 24 of the second layer of the free end 10 side is larger than that of the heat generation layer of the first layer. Alternatively, a metal layer 27 having a linear expansion coefficient larger than that of the heat generation layer 20 may be laminated on a thin insulation layer laminated on the upper surface of the heat generation layer 20, in place of the second dielectric layer 24 of the free end 10 side. Thus, as shown in FIG. 1C, the free end 10 side of the cantilever 4 is bent downward to the side opposite from the nozzle 3 (convexly bent toward the nozzle 3). If the linear expansion coefficients of the first dielectric layer 23 and the metal layer 27 and occupation ranges of them to be laminated are properly selected, the free end 10 side of the cantilever 4 can be made approximately parallel with the inner wall (a roof portion) of the liquid chamber when the cantilever 4 is bent to the maximum. Accordingly, a gap between the inner wall (a roof portion) of the liquid chamber and the free end 10 side (an ejection pressure applying portion) of the cantilever 4 can be made small, and ink residual quantity not to be ejected can be reduced. Additionally, bubbles generated on the free end 10 side of the cantilever 4 can be ejected together with an ink by making the gap small.

Figure 2A:
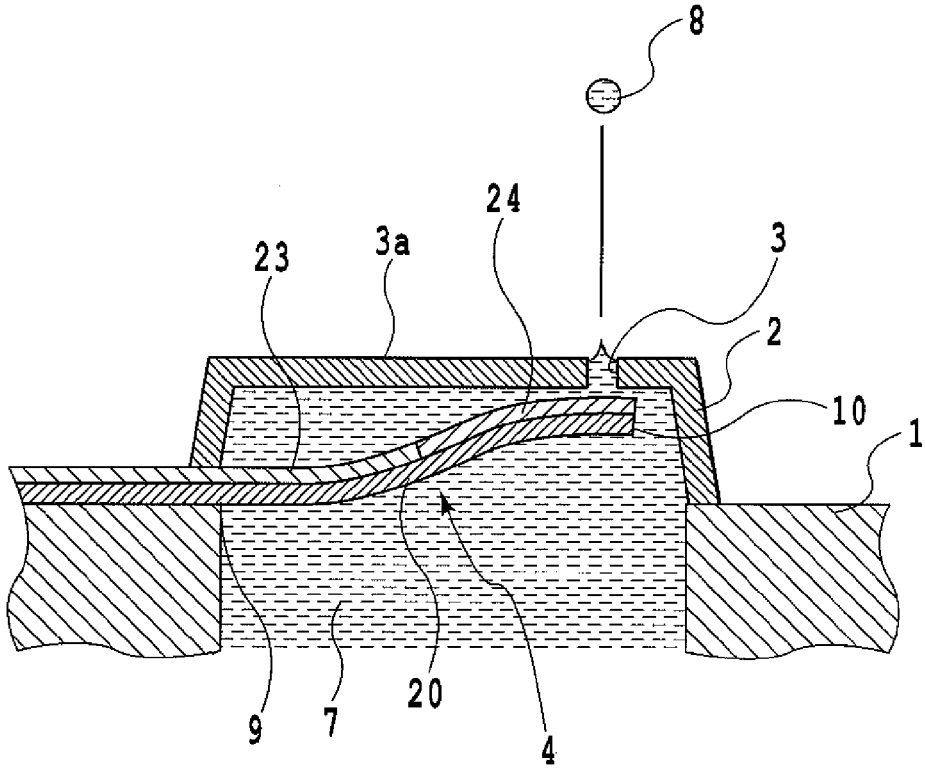
FIGS. 2A and 2B are views for describing a state where droplets are ejected from the ejecting portions of the print heads adjacent to each other in the case where the ejecting portions of the print heads according to the first embodiment of the present invention shown in FIG. 1 are arranged zigzag.
Figure 2B:
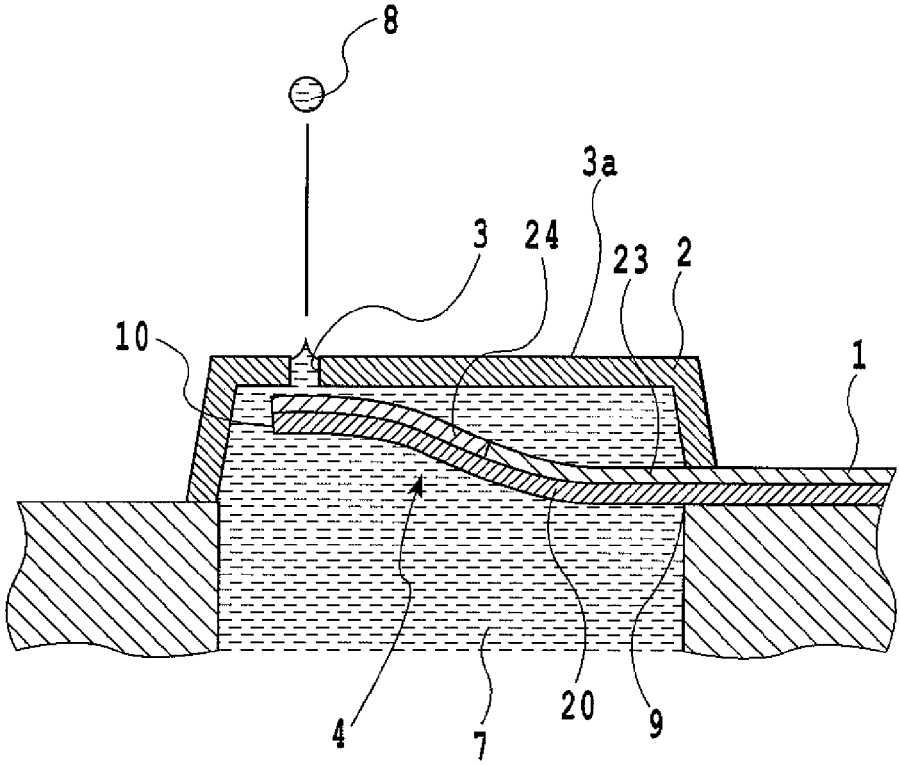

As shown in FIG. 2A, the cantilever 4 as the thermomechanical actuator thus constituted allows the droplet 8 to be ejected perpendicularly to a nozzle face 3*a*. This indicates that, as shown in FIGS. 2A and 2B, both droplets 8 can be ejected from the ejecting portions, which are adjacent to each other, perpendicularly to the nozzle face 3*a* even if the ejecting portions are arranged zigzag. That is, if it is assumed that an odd number is assigned to the ejecting portion shown in FIG. 2A, and that an even number is assigned to the ejecting portion shown in FIG. 2B, the ejecting portions being arranged zigzag, the ejecting direction of the droplet 8 ejected from the ejecting portion of the odd number can be made to approximately conform with that of the even number.

In the embodiment, as the second layer constituting the cantilever 4, a layer is cited that the two dielectric layers 23 and 24 having the linear expansion coefficients different from each other are formed as one continuous layer on the upper surface of the heat generation layer 20 from the fixed end 9 to the free end 10. However, the second layer is not limited to the above continuous layer. For example, the second layer of the cantilever 4 may be formed by properly selecting three or more dielectric layers having the linear expansion coefficients different from each other. Additionally, each dielectric layer is not always required to be continuously formed on the upper surface of the heat generation layer 20 as the first layer from the fixed end 9 to the free end 10. Alternatively, the two dielectric layers 23 and 24 having the linear expansion coefficients different from each other may be formed on a lower surface of the heat generation layer 20 from the fixed end 9 to the free end 10. In this case, the material of the first dielectric layer 23 of the fixed end 9 side is selected so as to have the linear expansion coefficient much larger than that of the heat generation layer 20, and the material of the second dielectric layer 24 of the free end 10 side is selected so as to have the linear expansion coefficient not much larger than or smaller than that of the heat generation layer 20.

Second Embodiment

Figure 3A:
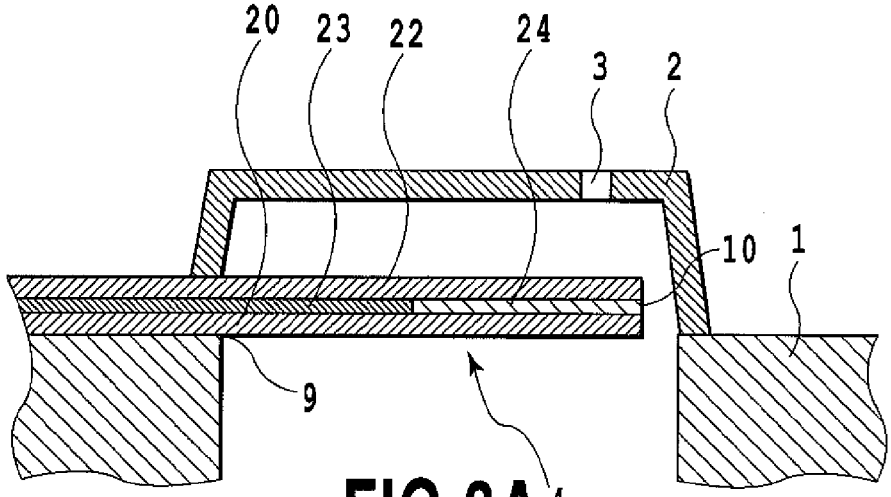
FIGS. 3A to 3C are views for description of a second embodiment according to the present invention.
Figure 3B:
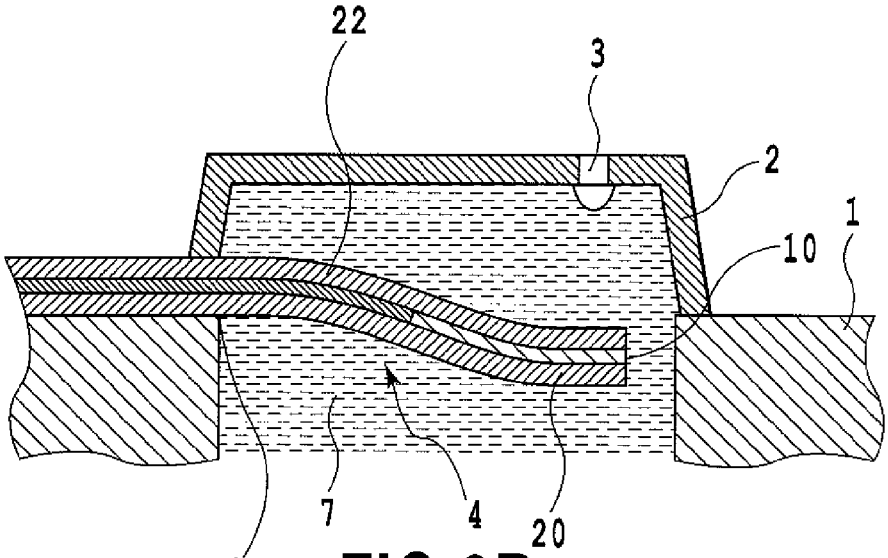
Figure 3C:
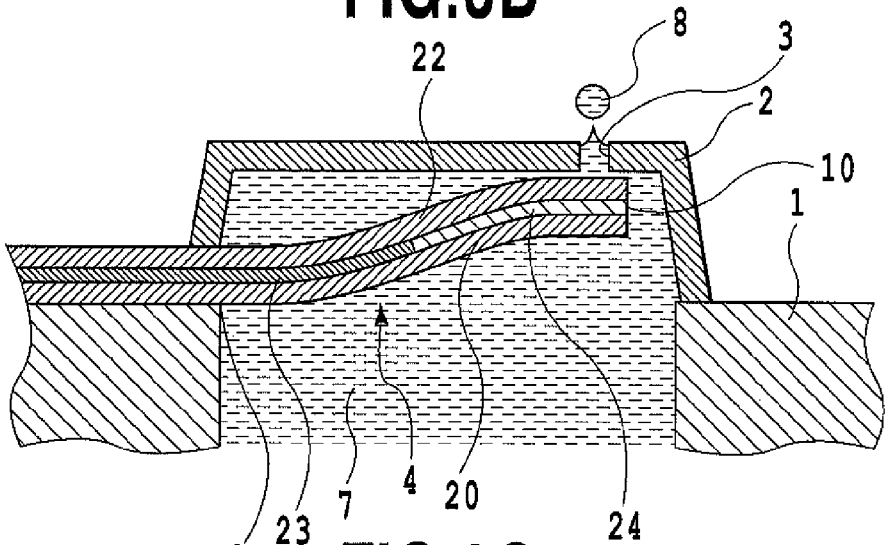

FIGS. 3A to 3C are each cross sectional views of an ejecting portion of a print head according to a second embodiment of the present invention.

In a cantilever 4 as the thermomechanical actuator in the embodiment, a second heat generation layer 22 is further laminated on the cantilever 4 of the first embodiment. That is, in the cantilever 4 of the embodiment, the second heat generation layer 22 as a third layer is further laminated on an upper surface of the second layer, which includes the first dielectric layer 23 and second dielectric layer 24, of the first embodiment. In the embodiment, the metal layer 27 may be laminated in place of the second dielectric layer 24 like the first embodiment. In this case, thin insulation layers are laminated between the metal layer 27 and the first heat generation layer 20 and between the metal layer 27 and the second heat generation layer 22, respectively.

According to such a constitution, first, the second heat generation layer 22 is energized to generate heat in the cantilever 4 of the embodiment. The linear expansion coefficient of the first dielectric layer 23 is smaller than that of the second heat generation layer 22, and thus the fixed end 9 side of the cantilever 4 is bent to the side opposite from the nozzle 3 as shown in FIG. 3B. Additionally, since the linear expansion coefficient of the second dielectric layer 24 is not much smaller than that of the second heat generation layer 22, the free end 10 side of the cantilever 4 extends approximately straight. Alternatively, in the case where the second dielectric layer 24 is replaced with the metal layer 27, since the linear expansion coefficient of the metal layer 27 is larger than that of the second dielectric layer 24, the free end 10 side of the cantilever 4 is conversely bent toward the nozzle 3. Here, the first heat generation layer 20 follows the bend of the second layer. Next, the cantilever 4 is cooled (the second heat generation layer 22 is not energized), and the first heat generation layer 20 is energized to generate heat. Then, the fixed end 9 side of the cantilever 4 is bent toward the nozzle 3 as shown in FIG. 3C. Additionally, the free end 10 side of the cantilever 4 is bent to the side opposite from the nozzle 3. The cantilever 4 is thus bend-operated so that the amplitude of the free end 10 side of the cantilever 4, i.e. the ejection pressure applying portion, can be enlarged, and thus a larger ejection pressure for ejecting the droplet 8 can be obtained.

Third Embodiment

Figure 4A:
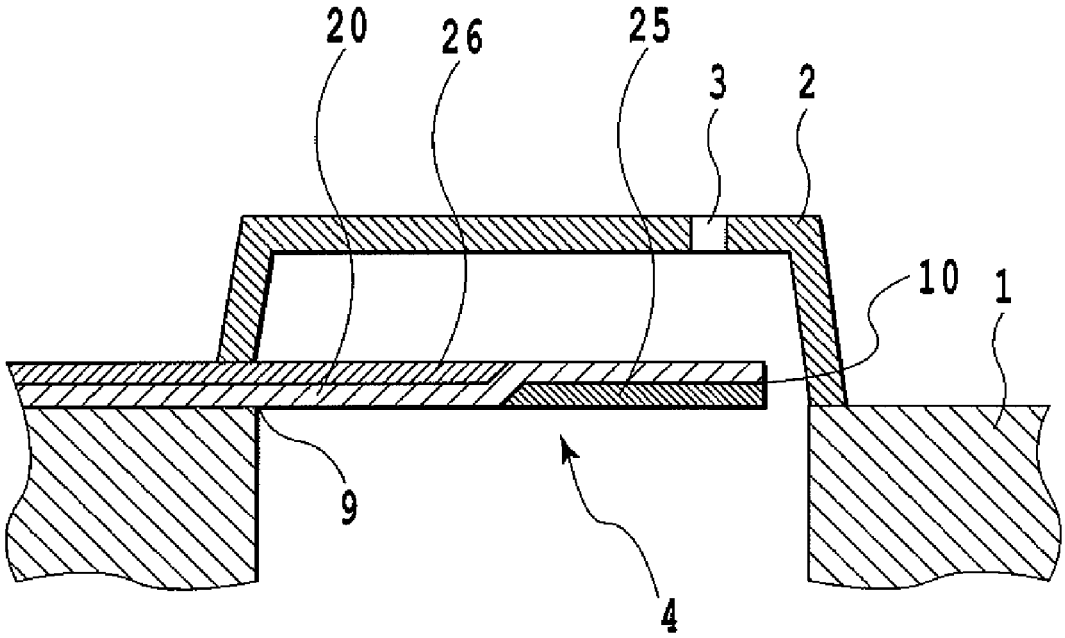
FIGS. 4A and 4B are views for description of a third embodiment according to the present invention.
Figure 4B:
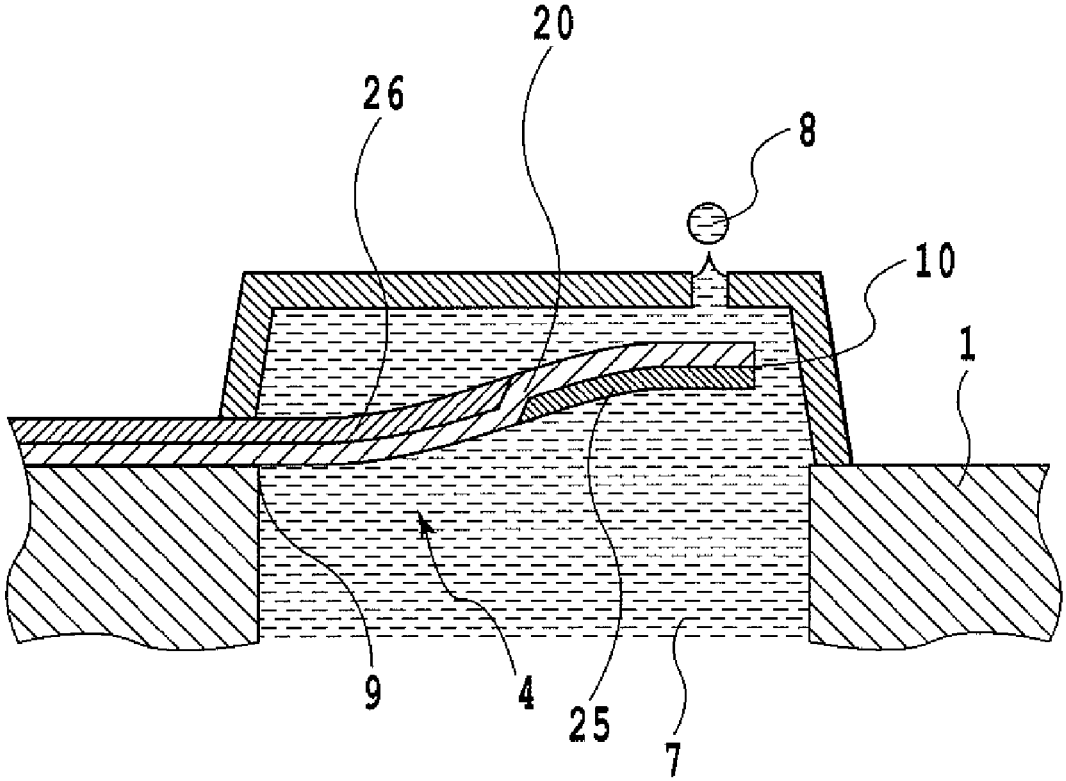

FIGS. 4A and 4B are each cross sectional views of an ejecting portion of a print head according to a third embodiment of the present invention.

A cantilever 4 as the thermomechanical actuator in the embodiment is a modification of the cantilever 4 of the first embodiment. That is, in the cantilever 4 of the embodiment, a second dielectric layer 26 is partially laminated on the upper surface (direction of ejecting droplets) of the heat generation layer 20 at the fixed end 9 side, and a first dielectric layer 25 is partially laminated on the lower surface of the heat generation layer 20 at the free end 10 side. In the embodiment, the first dielectric layer 25 and second dielectric layer 26, which constitute a second layer, are laminated so as to sandwich the heat generation layer 20 constituting a first layer therebetween. The cantilever 4 having such a constitution is formed in a manner that first, the first dielectric layer 25 is partially formed on the substrate 1, the heat generation layer 20 is laminated thereon, and lastly the second dielectric layer 26 is partially laminated on the heat generation layer 20. Each of the materials of the first dielectric layer 25 and second dielectric layer 26 is selected so as to have a linear expansion coefficient smaller than that of the heat generation layer 20. Moreover, the materials of the first dielectric layer 25 and second dielectric layer 26 may be the same.

In the cantilever 4 of the embodiment thus constituted, the fixed end 9 side of the cantilever 4 is bent upward and the free end 10 side thereof is bent downward when the heat generation layer 20 is energized to generate heat, and thus effects similar to those of the first embodiment and second embodiment can be obtained. Accordingly, if the linear expansion coefficients of the first dielectric layer 25 and second dielectric layer 26 and occupation ranges of them to be laminated are properly selected, the free end 10 side of the cantilever 4 can be made approximately parallel with the inner wall (a roof portion) of the liquid chamber when the cantilever 4 is bent to the maximum.

Fourth Embodiment

Figure 5A:
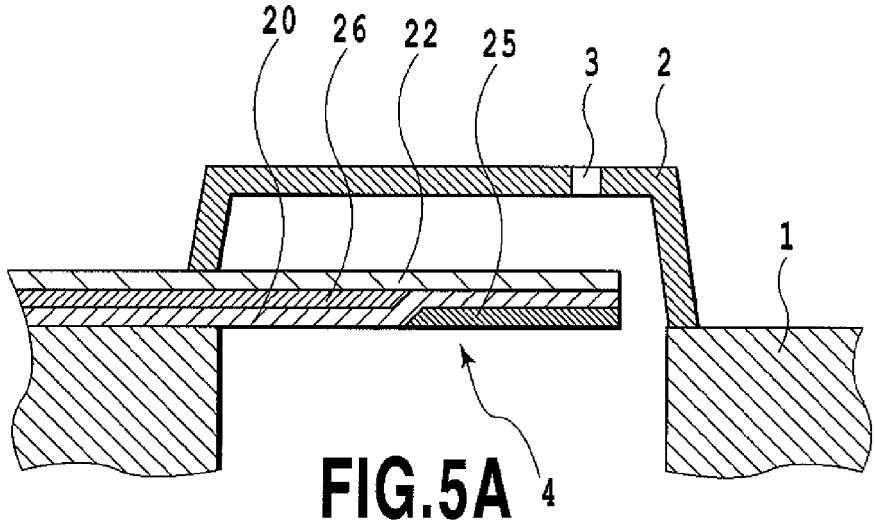
FIGS. 5A to 5C are each views for description of a fourth embodiment according to the present invention.
Figure 5B:
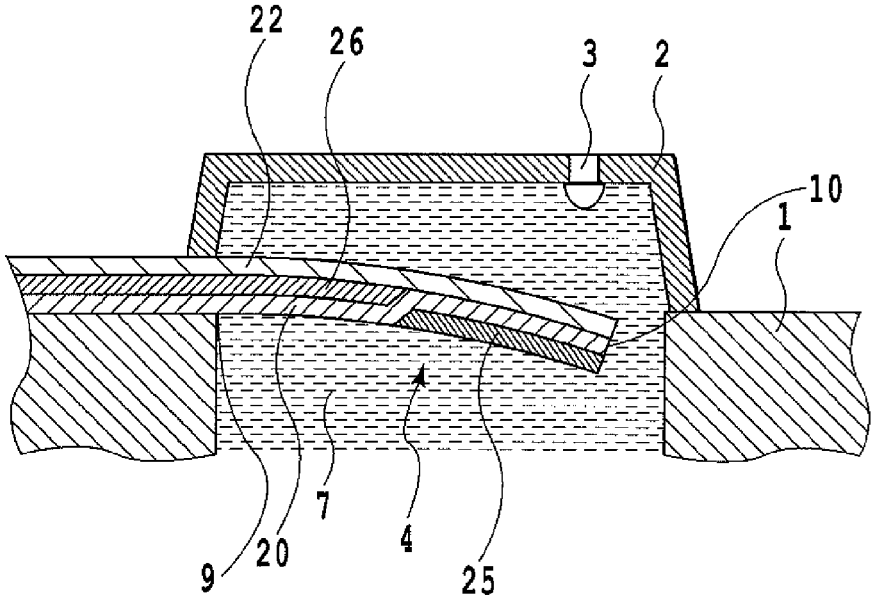
Figure 5C:
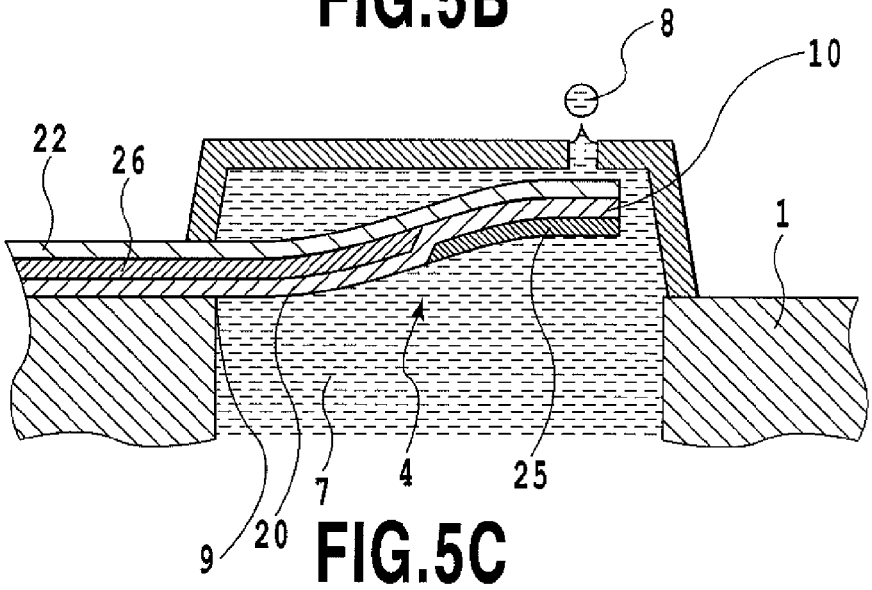

FIGS. 5A to 5C are each cross sectional views of an ejecting portion of a print head according to a fourth embodiment of the present invention.

A cantilever 4 as the thermomechanical actuator in the embodiment is formed in a manner that the second heat generation layer 22 as a third layer is further laminated on an upper surface (direction of ejecting droplets) of the cantilever of the third embodiment. According to such a constitution, when the second heat generation layer 22 is energized to generate heat, the cantilever 4 is bent to the side opposite from the nozzle 3 as shown in FIG. 5B. In this case, the linear expansion coefficient of the first dielectric layer 25 positioned under the second heat generation layer 22 of the fixed end 9 side of the cantilever 4 is much smaller than that of the second heat generation layer 22. Accordingly, the free end 10 side of the cantilever 4 can be greatly displaced downward. Next, after cooling the second heat generation layer 22, when the first heat generation layer 20 is energized to generate heat, the cantilever 4 is bent toward the nozzle 3 as shown in FIG. 5C. Further, the free end 10 side of the cantilever 4 can be made parallel with the nozzle face surface like the third embodiment. The cantilever 4 of the embodiment can provide ejection pressure larger than those of the cantilevers of the embodiments 1 to 3.

Fifth Embodiment

Figure 6:
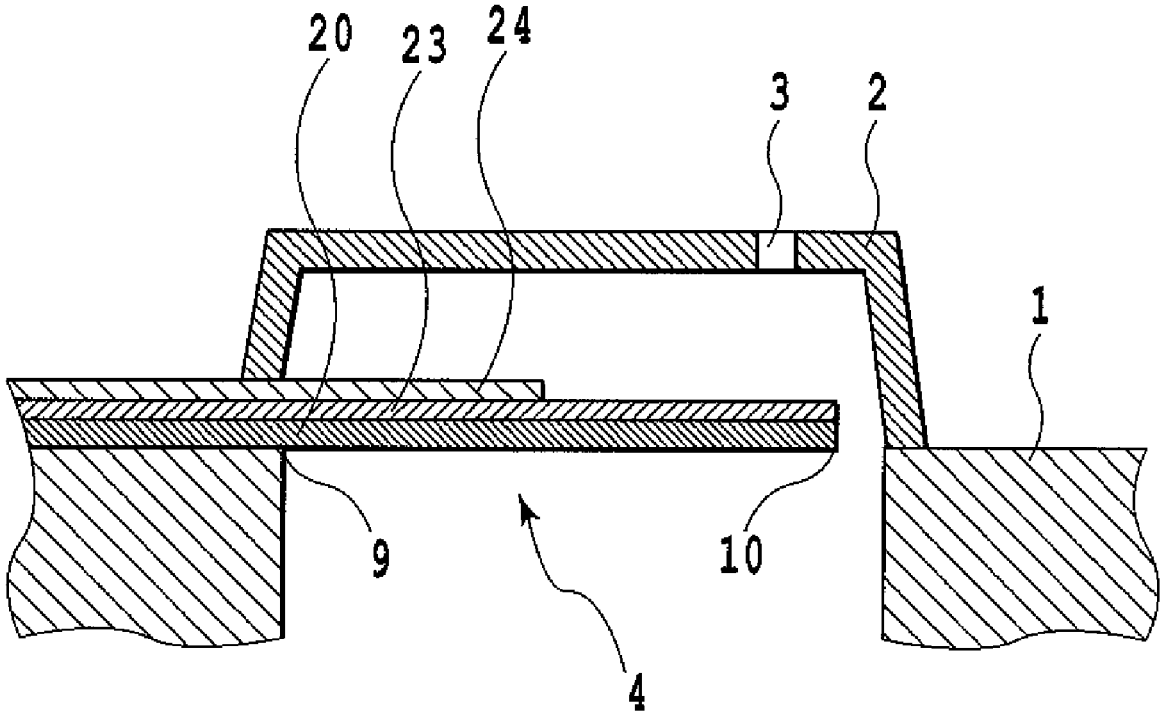
FIG. 6 is a view for description of a fifth embodiment according to the present invention, and is a cross sectional view of an ejecting portion of a print head according to the fifth embodiment.

FIG. 6 is a cross sectional view of an ejecting portion of a print head according to a fifth embodiment.

A cantilever 4 as the thermomechanical actuator in the embodiment is a modification of the cantilever 4 of the first embodiment. That is, the cantilever 4 of the embodiment is formed in a manner that the first dielectric layer 23 as the second layer is laminated on the upper surface of the heat generation layer 20 as the first layer, and the second dielectric layer 24 is partially laminated on the fixed end 9 side of on an upper surface (direction of ejecting droplets) of the dielectric layer 23. A material of the first dielectric layer 23 is selected so as to have a linear expansion coefficient not much smaller than that of the heat generation layer 20, and a material of the second dielectric layer 24 is selected so as to have the same linear expansion coefficient as the first dielectric layer 23 or smaller than that of the first dielectric layer 23. Additionally, film thicknesses of the first dielectric layer 23 and second dielectric layer 24 may be different from each other.

In the cantilever 4 of the embodiment thus constituted, the fixed end 9 side of the cantilever 4 has a film thickness for two layers, and a temperature distribution is formed in the dielectric layer in a film thickness direction by selecting a material having a relatively low thermal conductivity for the dielectric layer. Accordingly, the fixed end 9 side of the cantilever 4 of the embodiment is bent at a larger curvature, and a large driving force is obtained for ejecting droplets. Additionally, the free end 10 side of the cantilever 4 is constituted by only the first dielectric layer 23, and thus a curvature thereof is smaller than that of the fixed end 9 side, and an effect similar to that of the first embodiment can be obtained. That is, when the cantilever 4 is bent to the maximum, the free end 10 side of the cantilever 4 extends approximately straight, and can be made approximately parallel with the inner wall (a roof portion) of the liquid chamber 2 compared with the conventional cantilever. Further, as described regarding the first embodiment, the second layer of the free end 10 side of the cantilever 4 may be replaced with a metal layer.

Sixth Embodiment

Figure 7:
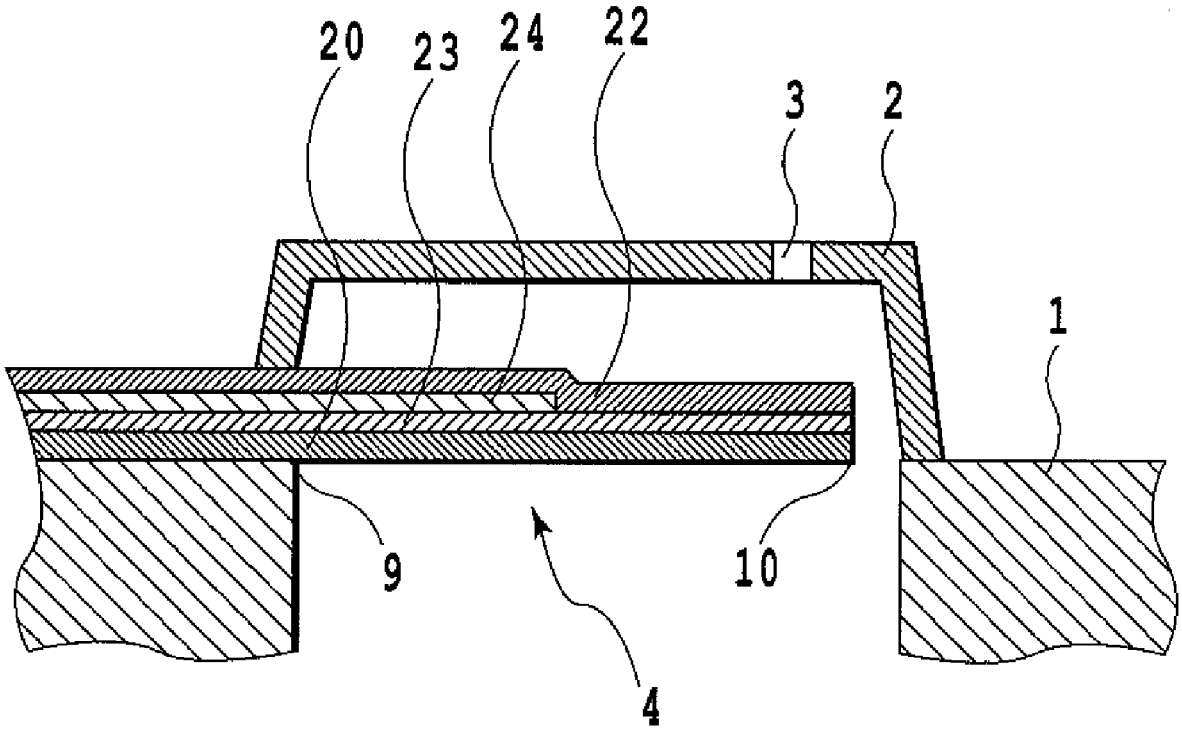
FIG. 7 is a view for description of a sixth embodiment according to the present invention, and is a cross sectional view of an ejecting portion of a print head according to the sixth embodiment.

FIG. 7 is a cross sectional view of an ejecting portion of a print head according to sixth embodiment of the present invention.

The cantilever 4 as the thermomechanical actuator in the embodiment is formed by further laminating the second heat generation layer 22 on an upper surface (direction of ejecting droplets) of the cantilever of the fifth embodiment. In the cantilever 4 thus constituted, when the second heat generation layer 22 is energized to generate heat, the cantilever 4 is bent to the side opposite from the nozzle 3. Next, after cooling the second heat generation layer 22, when the first heat generation layer 20 is energized to generate heat, the cantilever 4 is bent toward the nozzle 3. Accordingly, the cantilever 4 of the embodiment can obtain a larger ejection pressure for ejecting droplets.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-171691, filed Jun. 21, 2006, which is hereby incorporated by reference herein in its entirety.

What is claimed is:

1. A print head for ejecting droplets with a thermomechanical actuator having at least one first layer, and a second layer, wherein the thermomechanical actuator includes a fixed end and a free end, wherein the first layer of the thermomechanical actuator includes a heat generation layer, and the second layer thereof includes a plurality of dielectric layers having linear expansion coefficients different from each other, and wherein the plurality of dielectric layers are laminated on a droplet ejecting side in relation to the heat generation layer and between the fixed end and the free end at the same film thickness, and a linear expansion coefficient of the dielectric layer laminated at the fixed end side is smaller than that of the dielectric layer laminated at the free end side.

2. A print head for ejecting droplets with a thermomechanical actuator having at least one first layer, and a second layer, wherein the first layer of the thermomechanical actuator includes a heat generation layer, the second layer thereof includes a plurality of dielectric layers having linear expansion coefficients different from each other, and the thermomechanical actuator includes a fixed end and a free end, the plurality of dielectric layers are laminated on a droplet ejecting side in relation to the heat generation layer and between the fixed end and the free end at the same film thickness, a linear expansion coefficient of the dielectric layer laminated at the fixed end side is smaller than that of the heat generation layer, and a linear expansion coefficient of the dielectric layer laminated at the free end side is larger than that of the heat generation layer.

3. The print head according to claim 2, wherein a metal layer is laminated in place of a dielectric layer laminated at the free end side in the plurality of dielectric layers forming the second layer of the thermomechanical actuator, and a linear expansion coefficient of the metal layer is larger than that of the heat generation layer.

4. A print head for ejecting droplets with a thermomechanical actuator having at least one first layer, and at least one second layer, wherein the first layer of the thermomechanical actuator includes a first heat generation layer, and the second layer thereof includes first and second dielectric layers, wherein the thermomechanical actuator includes a fixed end and a free end, the first dielectric layer is laminated at the fixed end side of the thermomechanical actuator and on a droplet ejecting side in relation to the first heat generation layer, and the second dielectric layer is laminated at the free end side of the thermomechanical actuator and on the side opposite from the first dielectric layer laminated at the fixed end side on the first heat generation layer, and wherein a second heat generation layer as a third layer is further laminated on a droplet ejecting side in relation to the first dielectric layer and the first heat generation layer.

5. A print head for ejecting droplets with a thermomechanical actuator having at least one first layer, and at least one second layer, wherein the first layer of the thermomechanical actuator includes a first heat generation layer, and the second layer thereof includes first and second dielectric layers, wherein the thermomechanical actuator includes a fixed end and a free end, the first dielectric layer is laminated on a droplet ejecting side in relation to the first heat generation layer, and the second dielectric layer is laminated at the fixed end side of the thermomechanical actuator and further on the droplet ejecting side in relation to the first dielectric layer, and wherein film thicknesses of the first and second dielectric layers are different from each other.

6. A print head for ejecting droplets with a thermomechanical actuator having at least one first layer, and at least one second layer, wherein the first layer of the thermomechanical actuator includes a first heat generation layer, and the second layer thereof includes first and second dielectric layers, wherein the thermomechanical actuator includes a fixed end and a free end, the first dielectric layer is laminated on a droplet ejecting side in relation to the first heat generation layer, and the second dielectric layer is laminated at the fixed end side of the thermomechanical actuator and further on the droplet ejecting side in relation to the first dielectric layer, and wherein linear expansion coefficients of the first and second dielectric layers are different from each other.

* * * * *